US009273253B2

(12) United States Patent
Van Doesburg

(10) Patent No.: US 9,273,253 B2
(45) Date of Patent: Mar. 1, 2016

(54) PROCESS FOR THE PREPARATION OF A GAS OIL FRACTION

(75) Inventor: Edmundo Steven Van Doesburg, Amsterdam (NL)

(73) Assignee: Shell Oil Company, Houston, TX (US)

( * ) Notice: Subject to any disclaimer, the term of this patent is extended or adjusted under 35 U.S.C. 154(b) by 291 days.

(21) Appl. No.: 14/123,844

(22) PCT Filed: Jun. 8, 2012

(86) PCT No.: PCT/EP2012/060853

§ 371 (c)(1), (2), (4) Date: Feb. 24, 2014

(87) PCT Pub. No.: WO2012/168402

PCT Pub. Date: Dec. 13, 2012

(65) Prior Publication Data

US 2014/0158585 A1 Jun. 12, 2014

(30) Foreign Application Priority Data

Jun. 9, 2011 (EP) ..... 11169370

(51) Int. Cl.
*C10G 7/00* (2006.01)
*C10G 65/14* (2006.01)

(52) U.S. Cl.
CPC *C10G 7/00* (2013.01); *C10G 65/14* (2013.01); *C10G 2300/202* (2013.01); *C10G 2300/301* (2013.01); *C10G 2400/02* (2013.01); *C10G 2400/06* (2013.01); *C10G 2400/08* (2013.01)

(58) Field of Classification Search
CPC .... C10G 7/00; C10G 65/14; C10G 2300/202; C10G 2300/301; C10G 2400/02; C10G 2400/06; C10G 2400/08
See application file for complete search history.

(56) References Cited

U.S. PATENT DOCUMENTS 3,240,694 A 3/1966 Mason et al.
3,537,977 A 11/1970 Smith
5,403,469 A * 4/1995 Vauk ..... C10G 69/04 208/102
2007/0056879 A1 3/2007 Euzen et al.

FOREIGN PATENT DOCUMENTS

WO 2006066911 6/2006

* cited by examiner

*Primary Examiner* — Brian McCaig
(74) *Attorney, Agent, or Firm* — Charles W. Stewart

(57) ABSTRACT

The invention provides a process for the preparation of a gas oil fraction comprising the steps of: (a) providing a stream of a first hydrocarbon product of which a major portion of the hydrocarbons have a boiling point in the range of from 370-540° C. and a stream of a second hydrocarbon product of which a major portion of the hydrocarbons have a boiling point of less than 370° C.; (b) separating at least part of the stream of the first hydrocarbon product in a separating section into a gaseous stream and a liquid stream; (c) separating at least part of the second hydrocarbon product stream in a separating section into a gaseous stream and a liquid stream; (d) introducing at least part of the liquid stream as obtained in step (b) and at least part of the liquid stream as obtained in step (c) into a fractionating section to obtain a number of fractions of hydrocarbons including a gas oil fraction, wherein the at least part of the liquid stream as obtained in step (b) is introduced into the fractionating section at a level which is lower than the level at which the at least part of the liquid stream as obtained in step (c) is introduced into the fractionating section; and (e) recovering from the fractionating section the gas oil fraction.

9 Claims, 1 Drawing Sheet

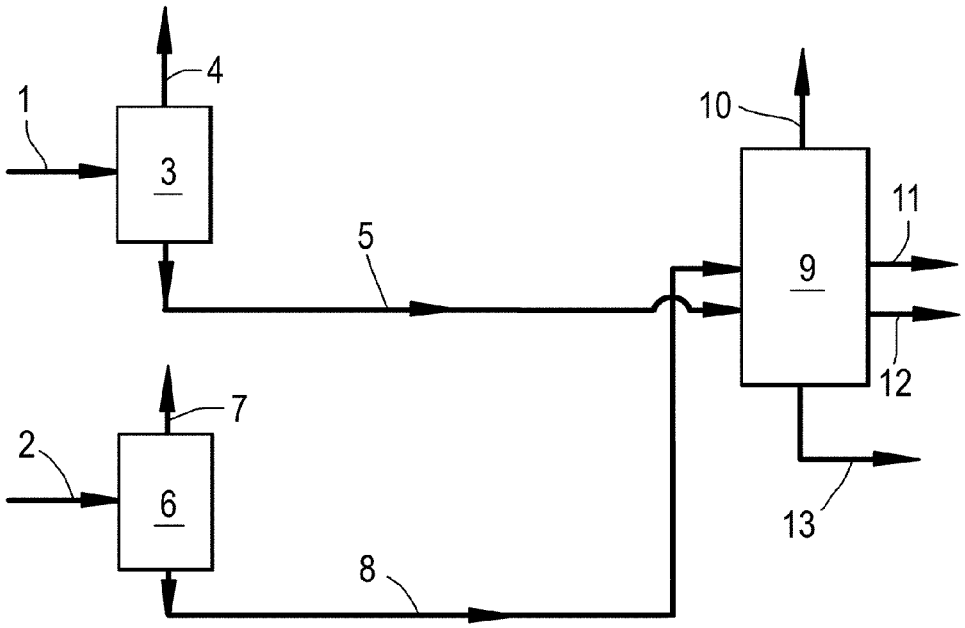
1
2
3
4
5
6
7
8
9
10
11
12
13

PROCESS FOR THE PREPARATION OF A GAS OIL FRACTION

PRIORITY CLAIM

The present application is a National Stage (§371) application of International Application No. PCT/EP2012/060853, filed 8 Jun. 2012, which claims the benefit of European Application No. 11169370.1, filed 9 Jun. 2011, the disclosures of which are incorporated herein by reference.

FIELD OF THE INVENTION

The present invention relates to a process for the preparation of a gas oil fraction.

BACKGROUND OF THE INVENTION

The preparation of gas oil is nowadays important in view of the increasing demand for this type of refinery product. It is known to prepare a gas oil fraction and other hydrocarbon fractions such as naphtha, kerosene and wax by combining different refinery product streams and subjecting the combined stream obtained to a fractionating process.

For example, a high quality gas oil fraction can be obtained by combining a product stream obtained by hydrocracking a vacuum gas oil with a product stream that has been obtained by hydrotreating a gas oil, and separating the combined products stream in a fractionating section to obtain a number of hydrocarbon fractions, including the gas oil fraction. The general drawback of such a combined processing of product streams is that the energy efficiency of the fractionating section to be used leaves much room for improvement.

Thus, there is a need to prepare high quality gas oil from combined refinery product streams wherein the above drawback is sufficiently dealt with.

SUMMARY OF THE INVENTION

It has now been found that this can attractively be realised when two different refinery product streams are subjected to a separate separation treatments and the separate liquid streams so obtained are introduced into the fractionating section at particular levels with respect to each other.

Accordingly, the present invention relates to a process for the preparation of a gas oil fraction comprising the steps of:

(a) providing a stream of a first hydrocarbon product of which a major portion of the hydrocarbons have a boiling point in the range of from 370-540° C. and a stream of a second hydrocarbon product of which a major portion of the hydrocarbons have a boiling point of less than 370° C.;

(b) separating at least part of the stream of the first hydrocarbon product in a separating section into a gaseous stream and a liquid stream;

(c) separating at least part of the second hydrocarbon product stream in a separating section into a gaseous stream and a liquid stream;

(d) introducing at least part of the liquid stream as obtained in step (b) and at least part of the liquid stream as obtained in step (c) into a fractionating section to obtain a number of fractions of hydrocarbons including a gas oil fraction, wherein the at least part of the liquid stream as obtained in step (b) is introduced into the fractionating section at a level which is lower than the level at which the at least part of the liquid stream as obtained in step (c) is introduced into the fractionating section; and (e) recovering from the fractionating section the gas oil fraction.

In accordance with the present invention a highly energy-efficient process for the preparation of a gas oil fraction is provided.

DETAILED DESCRIPTION OF THE INVENTION

The present invention relates to a process for preparing a gas oil fraction.

In step (a), a stream of a first hydrocarbon product of which a major portion of the hydrocarbons have a boiling point in the range of from 370-540° C. and a stream of a second hydrocarbon product of which a major portion of the hydrocarbons have a boiling point of less than 370° C. are provided. In the context of the present invention the term "major portion" is defined as least 50 wt % of the hydrocarbon product concerned, based on total weight of the hydrocarbon product. Preferably, the first hydrocarbon product contains at least 75 wt %, more preferably at least 80 wt %, even more preferably at least 90 wt % of hydrocarbons having a boiling point in the range of from 370-540° C., based on total weight of the first hydrocarbon product, and the second hydrocarbon product stream contains at least 75 wt %, more preferably at least 80 wt %, even more preferably at least 90 wt % of hydrocarbons having a boiling point of less than 370° C., based on total weight of the second hydrocarbon product. Suitably, the second hydrocarbon product comprises less than 20 ppm sulphur. Preferably, both the first and second hydrocarbon product streams comprise less than 20 ppm sulphur. Suitably, at least part of the first hydrocarbon product is derived from a hydrocracking process and at least part of the second hydrocarbon product is derived from a hydrotreating process. Preferably, the entire first hydrocarbon product is derived from a hydrocracking process and the entire second hydrocarbon product is derived from a hydrotreating process. Preferably, the hydrocracking process is a mild hydrocracking process and the hydrotreating process is a hydrodesulphurization process. Other suitable hydrotreating processes from which the second hydrocarbon product stream may be derived include dewaxing processes and/or cetane or density improvement. The feed for such a hydrocracking process can suitably be selected from the group consisting of a vacuum gas oil, heavy gas oil, cycle oil, or residue. The feed for such a hydrotreating process can suitably be selected from straight run gas oil, visbreaker gas oil, condensate or a cycle oil obtained from catalytic cracking.

In step (b), at least part of the stream of the first hydrocarbon product is separated in a separating section into a gaseous stream and a liquid stream. Preferably, in step (b) the entire stream of the first hydrocarbon product is separated in the separating section into a gaseous stream and a liquid stream. The liquid stream as obtained in step (b) contains at least 50 wt %, preferably at least 75 wt %, more preferably at least 80 wt %, and even more preferably at least 90 wt % of hydrocarbons having a boiling point in the range of from 370-540° C., based on total weight of the liquid stream. Suitably, step (b) can be carried out at a temperature in the range of from 175-300° C., preferably 230-280° C. and a pressure in the range of from 40-175 bar, preferably in the range of from 100-150 bar.

In step (c), at least part of the second hydrocarbon product stream is separated in a separating section into a gaseous stream and a liquid stream. Preferably, in step (c) the entire second hydrocarbon product stream is separated in the separating section into a gaseous stream and a liquid stream. The liquid stream as obtained in step (c) contains at least 50 wt %, preferably at least 75 wt % of hydrocarbons having a boiling point of less than 370° C., based on total weight of the liquid stream. Suitably, also step (c) can be carried out at a temperature in the range of from 175-300° C., preferably 200-240° C. and a pressure in the range of from 40-175 bar, preferably in the range of from 70-120 bar. Steps (b) and (c) may be carried out in separate separating sections or in a single separating section having different separating sections for the respective hydrocarbon product streams. If separate separating sections are applied in steps (b) and (c), the gaseous stream as obtained in step (c) can suitably be passed to the separating section in step (b).

The separating conditions in steps (b) and (c) may be similar or different. Preferably, the same separating conditions are used in both steps (b) and (c).

Suitably, steps (b) and (c) can be carried out in different separating sections of a single separating entity.

In step (d), at least part of the liquid stream as obtained in step (b) and at least part of the liquid stream as obtained in step (c) are introduced into a fractionating section to obtain a number of fractions of hydrocarbons including a gas oil fraction. At least part of the liquid stream as obtained in step (b) is introduced into the fractionating section at a level which is lower than the level at which the at least part of the liquid stream as obtained in step (c) is introduced into the fractionating section.

The temperature at which the liquid stream as obtained in step (b) is introduced into the fractionating section in step (d) is suitably in the range of from 175-300° C., preferably in the range of from 230-280° C.

The temperature at which the liquid stream as obtained in step (c) is introduced into the fractionating section in step (d) is suitably in the range of from 175-300° C., preferably in the range of from 200-240° C.

Preferably, the entire liquid stream as obtained in step (b) is introduced into the fractionating section in step (d). Preferably, the entire liquid stream as obtained in step (c) is introduced into the fractionating section in step (d). More preferably, the entire liquid streams as obtained in steps (b) and (c) are introduced into the fractionating section in step (d).

Preferably, the entire liquid stream as obtained in step (b) is introduced into the fractionating section at a level which is lower than the level at which the at least part of the liquid stream as obtained in step (c) is introduced into the fractionating section.

Suitably, at least part of the gaseous stream as obtained in step (b) and/or at least part of the gaseous stream as obtained in step (c) are condensed and at least part of the liquid stream(s) so obtained are introduced into the fractionating section in step (d). Preferably, the entire gaseous stream as obtained in step (b) and/or the entire gaseous stream as obtained in step (c) are subject to a condensation treatment in which at least part of the gaseous stream condensates and at least part of the liquid stream(s) so obtained are introduced into the fractionating section in step (d). More preferably, the entire gaseous stream as obtained in step (b) and the entire gaseous stream as obtained in step (c) are subject to a condensation treatment in which at least part of the gaseous stream condensates and the entire liquid stream(s) so obtained are introduced into the fractionating section in step (d).

Suitably, at least part of the liquid stream(s) so obtained by condensation are introduced into the fractionating section at a level which is higher than the level at which at least part of both the liquid streams as obtained in steps (b) and (c) are introduced into the fractionating section. Preferably, the entire liquid stream(s) so obtained by condensation are introduced into the fractionating section at a level which is higher than the level at which at least part of both the liquid streams as obtained in steps (b) and (c) are introduced into the fractionating section.

In step (d), the bottom part of the fractionating section is suitably be operated at a temperature in the range of from 250-400° C., preferably 340-380° C., and the upper part of the fractionating section is operated at a temperature in the range of from 50-150° C., preferably 70-90° C., and the pressure in both parts is in the range of from 1-8 bar, preferably 2-4 bar.

If desired, the liquid streams as obtained in steps (b) and (c) can at least partly be cooled, for instance by means of power recovery, before they are passed to the fractionating section in step (d). The cooled liquid streams so obtained can suitably be subjected together to further separate separation treatments to obtain gaseous streams and liquid streams, which separate liquid streams can then be passed to the fractionating section in step (d). Such separate separation treatments can be carried out in different sections of a single separating entity. Suitably, the pressure of the liquid streams as obtained in steps (b) and (c) is reduced before the liquid streams are introduced into the fractionating section in step (d).

The combination of steps (b), (c) and the introduction of the two liquid streams at particular levels with respect to each other in step (d) results in a very attractive energy-efficiency of the fractionating section. The heat required in step (d) can considerably be reduced, resulting in a significant reduction of the size of required heat input, such as a furnace or hot oil heater to be used in the fractionating section in step (d). As a result of such a size reduction of the furnace to be used the diameter of the fractionating section can attractively be reduced. The diameter of the fractionating section can be reduced by up to 30%, whereas the energy-efficiency improvement can be between 30-60%.

In step (e), the gas oil fraction as obtained in step (d) is recovered. Suitably, in step (e) in addition to the gas oil fraction one or more additional fractions can be recovered such as a naphtha fraction, a kerosene fraction and/or a wax fraction.

FIG. 1 shows a simplified flow scheme of an embodiment of the present invention. FIG. 1 shows a line 1 via which a stream of a first hydrocarbon product stream of which a major portion of the hydrocarbons have a boiling point in the range of from 370-540° C. is provided, and a line 2 via which a stream of a second hydrocarbon product stream of which a major portion of the hydrocarbons have a boiling point of less than 370° C. is provided. The first hydrocarbon product is separated in a separating section 3 into a gaseous stream which is withdrawn via a line 4 and a liquid stream which is withdrawn via a line 5. The second hydrocarbon product is separated in a separating section 6 into a gaseous stream which is withdrawn via a line 7 and a liquid stream which is withdrawn via a line 8. The liquid stream as obtained from the separating section 6 is then via the line 8 introduced into a fractionating section 9. The liquid stream as obtained from the separating section 3 is then via the line 5 introduced into the fractionating section 9 at a level which is lower than the level at which the liquid stream from the separation section 6 is introduced into the fractionating section 9. The gaseous streams withdrawn via lines 4 and 7 may be condensed and separately introduced into the fractionating section 9. From the fractionating section 9, a naphtha fraction is recovered via a line 10, a kerosene fraction may be recovered via a line 11, a gas oil fraction is recovered via a line 12, and a hydrowax fraction is recovered via a line 13.

The following Example will further elucidate the invention.

EXAMPLE

The benefit of the invention can be shown in terms of energy-efficiency and capital expenditures by comparing a conventional fluid catalytic cracking pre-treater process design with a process design according to the invention. In the conventional process design the effluent from a hydrocracking unit and the effluent from a hydrodesulphurization unit are subjected to combined separation treatments and fractionating in a fractionating column. The effluent from the hydrocracking unit contains a significant part of unconverted oil (hydrowax). The effluent from the hydrodesulphurization unit consists mainly of diesel with a small front end of naphtha and kerosene, and must be stripped for $H_2S$ removal. The hydrocracking unit and the hydrodesulphurization unit operate at the same pressure. In the conventional design the streams of the hydrocracking unit and the hydrodesulphurization unit make combined use of a separator system which, consists of a hot high pressure separator, a cold high pressure separator, a hot low pressure separator and a cold low pressure separator. This has as a consequence that most of the diesel is passed as a liquid product from the hot low pressure separator HLPS to a fractionating column. In the feed furnace of the fractionating column the diesel needs to be evaporated and condensed in the mid-circulating reflux (MCR) which operation costs a lot of energy. To overcome this drawback, the present invention provides a highly attractive novel process design wherein use is made of separate hot high pressure separators and separate hot low pressure separators for the respective hydrocracking unit and hydrodesulphurization unit effluents. The process design according to the present invention has the advantage that the effluent from the hot low pressure separator wherein the hydrodesulphurization unit effluent is separated can be passed to the middle part of the fractionating column, above the gasoil draw-off tray, and does not need to be evaporated by the fractionator feed furnace, as it is allowed to drop as a liquid to the gas oil drawoff tray. Although the yield structure of the novel process design is essentially similar to that of the original process design, the energy use of the novel process design was significantly less as the diesel did not need to be evaporated anymore. The novel process design brings about a drop in furnace duty from 51.9 MW down to 27.5 MW, which is close to the theoretical duty requirement to vaporise the gasoil (ca. 24 MW). As a result, the cost of the furnace is reduced by no less than about 30%. As a significant part of the process investment is required for the feed furnace of the fractionating column, a reduction in furnace size has a significant effect on total investment. Moreover, the reduction in feed furnace duty also reduces advantageously the column diameter from 4400 mm down to 3500, making the fractionating column no less than about 15% cheaper. Additionally, the number of heat exchangers is lower for the novel process design in accordance with the present invention since the steam generators in the circulating refluxes are no longer needed.

It will be clear from the above that the process according to the present invention constitutes a significant improvement in terms of energy-efficiency and capital expenditures when compared with the conventional process.

What is claimed is:

1. A process for the preparation of a gas oil fraction comprising the steps of:

(a) providing a first stream of a first hydrocarbon product of which a major portion of the hydrocarbons have a boiling point in the range of from 370-540° C. and a second stream of a second hydrocarbon product of which a major portion of the hydrocarbons have a boiling point of less than 370° C.;

(b) separating at least part of the first stream of the first hydrocarbon product in a separating section into a first gaseous stream and a first liquid stream;

(c) separating at least part of the second stream of the second hydrocarbon product in a separating section into a second gaseous stream and a second liquid stream;

(d) introducing at least part of the first liquid stream as obtained in step (b) and at least part of the second liquid stream as obtained in step (c) into a fractionating section to obtain a number of fractions of hydrocarbons including a gas oil fraction, wherein the at least part of the first liquid stream as obtained in step (b) is introduced into the fractionating section at a level which is lower that the level at which the at least part of the second liquid stream as obtained in step (c) is introduced into the fractionating section; and (e) recovering from the fractionating section the gas oil fraction.

2. A process according to claim 1, wherein the first stream of the first hydrocarbon product contains at least 75 wt % of hydrocarbons having a boiling point in the range of from 370-540° C., based on the total weight of the first hydrocarbon product, and the second stream of the second hydrocarbon product stream contains at least 75 wt % of hydrocarbons having a boiling point of less than 370° C., based on the total weight of the second hydrocarbon product.

3. A process according to claim 1, wherein the second stream of the second hydrocarbon product comprises less than 20 ppm sulphur.

4. A process according to claim 1, wherein at least part of the first stream of the first hydrocarbon product is derived from a hydrocracking process and at least part of the second stream of the second hydrocarbon product is derived from a hydrotreating process.

5. A process according to claim 4, wherein the hydrocracking process is a mild hydrocracking process and the hydrotreating process is a hydrodesulphurization process.

6. A process according to claim 1, wherein steps (b) and (c) are each carried out at a temperature in the range of from 175-300° C. and a pressure in the range of from 40-175 bar.

7. A process according to claim 1, wherein in step (d) the bottom part of the fractionating section is operated at a temperature in the range of from 250-400° C., and the upper part of the fractionator is operated at a temperature in the range of from 50-150° C. and a pressure is applied in both parts in the range of from 1-8 bar.

8. A process according to claim 1, wherein steps (b) and (c) are carried out in different separating sections of a single separating entity.

9. A process according to claim 1, wherein in step (e) in addition to the gas oil fraction a naphtha fraction, a kerosene fraction and/or a wax fraction are recovered.

* * * * *